US012048323B2

(12) United States Patent
Capo et al.

(10) Patent No.: US 12,048,323 B2
(45) Date of Patent: Jul. 30, 2024

(54) CASTING APPARATUS AND METHOD FOR THE PRODUCTION OF A CAST SHEET OF A MATERIAL CONTAINING ALKALOIDS

(71) Applicant: PHILIP MORRIS PRODUCTS S.A., Neuchatel (CH)

(72) Inventors: Silvia Capo, Capaccio-Paestum (IT); Marc A. F. Van Den Boogaart, Giez (CH)

(73) Assignee: Philip Morris Products S.A., Neuchatel (CH)

( * ) Notice: Subject to any disclaimer, the term of this patent is extended or adjusted under 35 U.S.C. 154(b) by 771 days.

(21) Appl. No.: 16/973,086

(22) PCT Filed: Jun. 28, 2019

(86) PCT No.: PCT/EP2019/067470
§ 371 (c)(1),
(2) Date: Dec. 8, 2020

(87) PCT Pub. No.: WO2020/002676
PCT Pub. Date: Jan. 2, 2020

(65) Prior Publication Data

US 2021/0212356 A1 Jul. 15, 2021

(30) Foreign Application Priority Data

Jun. 29, 2018 (EP) ..... 18181032

(51) Int. Cl.
*A24B 3/14* (2006.01)
*A24B 15/167* (2020.01)

(52) U.S. Cl.
CPC ..... *A24B 3/14* (2013.01); *A24B 15/167* (2016.11)

(58) Field of Classification Search
CPC ..... A24B 3/14; A34B 15/14; A34B 15/167; A24C 5/01; A21F 1/02
(Continued)

(56) References Cited

U.S. PATENT DOCUMENTS 5,724,998 A 3/1998 Gellatly
7,578,906 B2 * 8/2009 Shands et al. ..... D21F 1/06 162/343
2017/0340001 A1 11/2017 Soo

FOREIGN PATENT DOCUMENTS

EP 0565360 10/1993
EP 0589298 3/1994
(Continued)

OTHER PUBLICATIONS

Office Action issued in Russia for Application No. 2021101891 dated Dec. 8, 2022 (6 pages). English translation included.
(Continued)

*Primary Examiner* — Christopher M Rodd
*Assistant Examiner* — Ronnie Kirby Jordan
(74) *Attorney, Agent, or Firm* — Mueting Raasch Group

(57) ABSTRACT

The invention relates to a casting apparatus (100) to cast a sheet (50) of a material containing alkaloids, the casting apparatus including: • a casting box (10) adapted to contain a slurry (18) to be cast to form the sheet, the casting box defining an inner volume; • a slurry supply element (5) defining a supply channel (15) adapted to feed the slurry along a supply direction in the inner volume of the casting box from an inlet (90), the supply direction forming an angle with a horizontal plane comprised between about −45 degrees and about +45 degrees; • a movable support (2); • and a casting element (1) adapted to cast the slurry contained in the casting box onto the movable support so as to form the
(Continued)

cast sheet. The invention also relates to a method to cast a sheet of a material containing alkaloids.

20 Claims, 4 Drawing Sheets

(58) Field of Classification Search
USPC ..... 131/372
See application file for complete search history.

(56) References Cited

FOREIGN PATENT DOCUMENTS

| | | |
|---|---|---|
| GB | 1 013 303 | 12/1965 |
| RU | 2109468 | 4/1998 |
| RU | 2119761 | 10/1998 |
| WO | WO 2016/096750 | 6/2016 |

OTHER PUBLICATIONS

Search Report and Written Opinion for PCT/EP2019/067470 dated Oct. 7, 2019 (10 pages).

* cited by examiner

CASTING APPARATUS AND METHOD FOR THE PRODUCTION OF A CAST SHEET OF A MATERIAL CONTAINING ALKALOIDS

This application is a U.S. National Stage Application of International Application No. PCT/EP2019/067470 filed Jun. 28, 2019, which was published in English on Jan. 2, 2020 as International Publication No. WO 2020/002676 A1. International Application No. PCT/EP2019/067470 claims priority to European Application No. 18181032.6 filed Jun. 29, 2018.

This invention relates to a casting apparatus and method for producing a cast web of a material containing alkaloids.

In particular, the material containing alkaloids is homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects of the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

There is a need for a casting apparatus and method for the production of a cast web of a material containing alkaloids that is adapted to overcome, or at least decrease, the above-mentioned issues.

The invention relates to casting apparatus to cast a sheet of a material containing alkaloids, the casting apparatus including: a casting box adapted to contain a slurry to be cast to form the sheet, the casting box defining an inner volume; a slurry supply element defining a supply channel adapted to feed the slurry along a supply direction in the inner volume of the casting box from an inlet, the supply direction forming an angle with a horizontal plane comprised between about −45 degrees and about +45 degrees; a movable support; and a casting element adapted to cast the slurry contained in the casting box onto the movable support so as to form the cast sheet.

The invention also relates to a casting apparatus to cast a sheet of a material containing alkaloids, the casting apparatus including: a casting box adapted to contain a slurry to be cast to form the sheet; a slurry supply element defining a supply channel adapted to feed the slurry along a supply direction inside the casting box from an inlet, the supply direction forming an angle with a horizontal plane comprised between about −45 degrees and about +45 degrees; a movable support; and a casting element adapted to cast the slurry contained in the casting box onto the movable support so as to form the cast sheet.

Supplying the slurry along a supply direction which is "horizontal" or along a supply direction forming an angle with an horizontal plane in a range of ±45 degrees, thus still having a bigger horizontal component than a vertical one, allows a better control of the inflow of slurry in the casting box because the flow is controlled more by the applied pressure than by gravity. Thanks to a supply channel which is not vertical, the formation of air bubbles inside the casting box is reduced or minimized; furthermore the slurry contained in the casting box is not affected by the potential energy of the falling slurry and this entails a more homogeneous (content and thickness) cast leaf due to a constant pressure condition within the casting box.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, it may have a rectangular or a rounded shape.

As used herein, the term "movable support" denotes any means comprising a surface that can be moved in at least one longitudinal direction. The movable support may form a closed loop so as to provide an uninterrupted transporting ability in one direction. However, the movable support may be moved in back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco material sheet can also be referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product, for example to an aerosol produced by heating the homogenized tobacco material. A cellulose pulp containing cellulose fibers is preferably added to the slurry in order to increase the tensile strength of the alkaloids material web, acting as a strengthening agent. A binder may be added. An aerosol-former may be added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The apparatus of the invention includes a casting box to contain the slurry and a movable support where the slurry is cast using a casting element. The movable support in its movement defines a casting direction.

The slurry may reach the casting box from a different location. The casting box therefore might not be the place where the slurry is formed. For example, the slurry may be created in a silo or tank, from where it is transferred to the casting box via suitable piping. Preferably, the slurry is continuously supplied to the casting box while the slurry is cast onto the movable support to form a continuous web of material containing alkaloids. The silo and the casting box are thus preferably fluidly connected in order to allow the slurry flowing from one to the other.

The casting-box is preferably box-shaped. Preferably, the casting box includes walls. More preferably, the walls in turn comprise sidewalls. The sidewalls may include a first and a second couple of opposite walls, called first, second sidewalls in the first couple, and third and fourth sidewalls in the second couple. The sidewalls are preferably advantageously substantially vertical, or tilted with respect to a vertical plane. First and second sidewall, and third and fourth sidewall, are respectively one facing the other. Preferably, the walls of casting box also include a bottom wall. The bottom wall may include an aperture. Preferably, the whole bottom part of the casting box defines an aperture. The bottom wall, alternatively, can be completely closed.

The casting box may include a closed top wall or a lid, or the top wall can include an aperture. In case of a lid, it can be fixed, or movable. In the latter case, it might be slidable on the sidewalls of the casting box.

The walls of the casting box defines an inner volume of the casting box itself, that is, the walls delimit an inner volume of the casting box. As mentioned, the casting box may include an aperture, for example in a bottom or top area, so that the box is not a completely closed container. The aperture is provided to cast the slurry. The inner volume of the casting box is thus in contact with the outside. Due to the presence of the aperture, as inner volume of the casting box, the volume of a "theoretical" box where the area defined by the aperture is closed is considered. The demarcation line between the inner volume of the box and the outside is preferably made therefore considering the aperture closed by a wall. The aperture may be formed in more than one wall (for example, corner apertures, which are apertures formed at the corners of the box). Further, more than a single aperture might be present in the casting box. The inner volume is considered as the volume inside the box defined by the walls in which all apertures are "virtually closed" by a geometrical continuation of the existing walls.

The casting element is preferably arranged perpendicular to the casting direction. Preferably, the casting element defines a longitudinal axis which is preferably arranged orthogonal to the casting direction. The web of material is formed by means of the casting element that casts the slurry present in the casting box into the movable support. The casting element may include a casting blade or a casting roller. In case of a casting blade, the casting box has preferably an opening in the bottom part and the movable support is positioned partly below the aperture. The slurry from the casting box comes into contact with the casting blade. An edge of the casting blade forms a gap with the surface of the movable support and the slurry passes through the aperture defined by said gap. The thickness of the cast web of material may be determined by the distance, among others, between the edge of the casting blade that comes into contact with the slurry and the surface of the movable support, that is, by the width of the above defined gap. In case of a casting roller, the casting box has preferably an aperture in the top part, and the movable support and the casting roller are both positioned facing the aperture and facing each other. Rotations of the roller, which is at least partly immerged in the slurry, causes a film of slurry to be casted onto the movable support. A gap is present between the casting roller and the movable support. The thickness of the cast web of material may be determined by the distance, among others, between the outer surface of the casting roller and the outer surface of the movable support, that is by the width of the above defined gap.

The slurry enters the casting box through a slurry supply element, which defines a supply channel. The supply channel is preferably as wide as the casting box, or slightly smaller, so that the slurry is deposited or enters substantially uniformly over the whole dimension of the casting box to minimize local increase of the slurry level. The supply channel defines an inlet for the slurry in the casting box, corresponding to the outlet of the supply channel from which the slurry exits. This inlet is preferably oblong. The supply channel might be considered as a pipe having an oblong, such as oval or rectangular, cross section. The cross section is made along a plane substantially perpendicular to the direction of flow of the slurry in the supply channel. To the supply channel, a single pipe or several pipes may converge transporting the slurry. The width of the cross section of the supply channel is preferably equal to the width of the inlet.

The supply channel feeds the slurry along a supply direction inside of the casting box from an inlet. The slurry enters the inner volume of the casting box along the supply direction imparted by the supply channel. At the inlet, the supply direction of the slurry forms an angle with a horizontal plane comprised between about −45 degrees and about +45 degrees. The supply channel therefore imparts a direction to the slurry flow which has the bigger component parallel to the horizontal plane at the inlet. The supply direction is the direction imparted to the slurry at the inlet. With "supply direction", the main direction of the slurry is considered.

The supply channel may be connected to a sidewall of the casting box. In this case, the inlet for the slurry includes an aperture formed in the casting box.

This configuration allows a better control on the flow of slurry than a supply of slurry along a substantially vertical direction. It may also allow avoiding the formation of different pressure zones within the casting box that may be responsible of an uneven cast sheet thickness.

Preferably, the slurry supply element includes a tapered end portion connected to the inlet.

Preferably, the casting box comprises lateral walls including an aperture defining the inlet. An insertion of slurry from one of the lateral walls, also called sidewalls, instead for example from an insertion from above, may further improve the homogeneity of the slurry because it minimize or limit the formation of air bubbles inside the slurry itself. The insertion of additional slurry in the casting box, via the inlet, is preferably performed below a given level of slurry in the casting box. Preferably, the given level of slurry in the casting box is kept substantially constant at a specified height or within a specified heights' range. Therefore, advantageously, while casting, there is a continuous flow of new slurry which is brought into the casting box via suitable piping. If the slurry is added in such a way that it fells onto the casting box, the slurry falling through air may incorporate air bubbles, which may cause defects in the cast web. With an inlet positioned in a sidewall below the given slurry level, air bubbles are difficult to form.

More preferably, the aperture extends for at least 50% of a width of one lateral wall. A "long" aperture allows distributing the slurry along the whole width of the casting box, therefore minimizing local increase of slurry level. An even supply improves the homogeneity of the slurry in the casting box. The width of the casting box is defined along a direction substantially perpendicular to the casting direction.

Preferably, the aperture extends along a main direction substantially parallel to a horizontal plane. This configuration may be useful in achieving a uniform "flat" level of slurry in the casting box.

Preferably, the main direction is substantially perpendicular to the supply direction. More preferably, the aperture is formed in a lateral wall opposite to the casting element. Preferably, the casting element is positioned at a lateral wall. The aperture is preferably realized on one of the sidewalls of the casting box opposite to the casting element. The sidewalls of the casting box are preferably substantially perpendicular, at least in a top view, to the casting direction.

Preferably, the supply direction forms an angle with a horizontal plane comprised between about −15 degrees and about +15 degrees. The supply direction is substantially horizontal.

Preferably, the casting apparatus comprises path diverting fins positioned within the feeding channel, the path diverting fins being apt to come into contact with the slurry inside the feeding channel; or path diverting fins adapted to come into contact with the slurry and placed within the casting box.

The casting box may include a plurality of fins. The fins change the flow path of the slurry flowing from the casting box towards the casting blade. The fins therefore divert the slurry from a substantially "linear" flow, that is a flow along a single substantially straight direction, generally dictated by gravity, to a more complex path because the slurry has to meander through the various surfaces defined by the fins.

Without being bound by theory, the slurry has probably a shear-thinning behavior, that is, there is an inverse proportion between its natural viscosity and the shear strain imposed. Thus, a good mixing of the slurry inside the casting box may be beneficial in the manufacturing process, in particular to control the thickness of the cast sheet. For this reason, preferably, fins which affect the flow of the slurry are inserted in the casting box. The fins, which may have a blade-like form, advantageously work as a mass distributor, as well as static mixing elements, as the slurry during its flow has to contour those fins, dispersing itself and creating non-linear flows. The slurry therefore has a "complex local movement" around the fins and at the same time an overall global movement flowing and moving by the movement of the conveying belt, towards the casting blade.

This way, a linear flow is avoided as much as possible, also in the region where the slurry goes through the thin gap between the casting blade and the conveying belt. According to the experience in production, longitudinal (in reference to the casting direction) linear flows of the slurry feeding the casting box, and/or inside the casting box, can be correlated with linear transversal inconsistency of the cast sheet of material, namely in terms of its thickness, physical characteristics, and visual appearance.

The specific geometry, size, number and relative proximity between the fins enable to define their effects in the flow of the slurry. These parameters may be designed by computer simulations, given the outline of the casting box and the characteristics of the slurry.

The fins have a dimension which is much smaller than the other two, which is their thickness. The fins are blade-like elements which are positioned in the casting box where they can interfere with the flow of the slurry. Each fin defines two substantially opposite main surfaces and a thin lateral surface connecting the two.

The fins may protrude from one of the sidewalls of the casting box, for example they can be fixed on such a sidewall and extends from an internal surface of the sidewall in contact to the slurry. Preferably, the main surfaces of each fin are substantially perpendicular to the side wall of the casting box.

Alternatively or in addition, the fins may face the movable support. The fins can be mounted so that they face with their lateral surface the movable support or the bottom aperture of the casting box. For this purpose, the fins may be connected all together by suitable bars or a frame fixed at the sidewalls of the casting box or the fins may be fixed to a lid of the casting box also facing the aperture.

In case many fins are present, all fins can be joined by a connecting element, such as a bar or a frame. The bar or frame may also connect the fins in groups. Each group might have a single connecting element different from the other groups. The connection is useful in order to remove all fins at the same time for cleaning or repairing purposes. Further, it is useful so that the position of all fins can be regulated at the same time.

The fins may be attached directly to the walls of the casting box. The fins may be connected by a frame and the frame may be attached to the sidewalls, preferably to opposite sidewalls, and the fins themselves may not be in contact with the walls of the casting box.

Each of the fins may define an axis or direction. The fins on a top view form substantially a curve. This curve has a first and a second end. The direction defined by the fins, thus their axis, is given by a line joining the first and the second end.

Preferably, a sub-group of the path diverting fins includes fins having parallel axis one to the other. Preferably, the fins form groups where all fins "point" toward the same direction. For example, the path diverting fins may be divided in rows, and each row includes fins having parallel axes among each other. The rows of fins are positioned one downstream the other along the direction of flow of the slurry, for example, if a first and a second row of fins are present, the first row of fins is located downstream the second row in the direction of flow of the slurry.

The fins are preferably curved, that is, they define a concave portion or a convex portion. The fins may have more than a concavity. In a top view, the fins therefore may define a C shape, a S shape or similar. They can also be planar. The referred potential standard shapes of the cross-sections of the blades/fins are the ones commonly used for similar purposes, namely to create the required "deviation" or reorientation of the slurry in each specific spot, and then the combination of those. In terms of materials, fins are preferably realized in metal, more preferably in hard metallic alloys, such as stainless steel hard alloys. Alternatively or in addition, fins may include hardened surfaces, or other materials that have high resistance to the abrasion of the slurry, due to the high content of silica of the tobacco particles and its known abrasion effect in all types of materials, including metals. The "hard" material or coating is used because of the wear caused by the slurry and the nicotine content of the slurry, which is chemically aggressive to materials in general.

The presence of fins in the flow path may reduce the differences in the fluidity and related physical characteristics of the slurry. Further "longitudinal shading bands" which may appear in the cast sheet without the presence of fins may be not present when fins are located in the casting box.

Preferably, the path diverting fins comprise a plurality of curved fins. Preferably, the fins are not flat, but they are curved. The main surfaces of the fins thus are preferably curved surface. The curvature may be used to change the direction of the flow of the slurry in a plurality of different directions, depending on the surface orientation of the fin hit by the slurry.

Preferably, the plurality of curved fins is arranged in at least one row of curved fins. Preferably, many fins are present. More preferably, the fins are arranged along the whole width of the casting box, which is substantially equal to the width of the casting blade, so that all the slurry which moves towards the casting element is affected by the fins presence. Preferably the fins are disposed one adjacent to the other leaving a space therebetween so that the slurry can flow therethrough, that is the slurry can flow between the two surfaces of the adjacent fins. The slurry therefore preferably flows through different channels, each channel being formed by two surfaces, one of a fin and one of the neighbour fin.

Preferably, each of the curved fins defines a concavity, the curved fins of a same row having equally oriented concavity. "Equally oriented concavity" means that all fins in a row have their concavity on the same side of their axis. The fins may have more than a single curvature. The fins of a row of fins, which preferably span the whole width of the casting box, have preferably their curvatures pointing all in the same direction.

Preferably, the curved fins of two adjacent rows have their concavity oppositely oriented. The movement imparted to the flow by the fins is "as complex as possible" so that it deviates from linearity and a better mixing is obtained.

The same fins above described can be mounted inside the supply channel.

The casting box may include a plurality of fins positioned in the supply channel. The fins change the flow path of the slurry flowing into the supply channel. The fins therefore divert the slurry from a substantially "linear" flow, that is a flow along a single substantially straight direction, to a more complex path because the slurry has to meander through the various surfaces defined by the fins. In this way, if in the supply channel slurry from different pipes arrives, the fins allow a mixing and merging of the different incoming flows in a single more homogeneous one.

The portion of the feeding channel containing the path diverting fins may be detached and removed from the slurry supply element, and more preferably attached again, for example after cleaning or repair.

The fins have a dimension which is much smaller than the other two, which is their thickness. The fins are blade-like elements which are positioned in the feeding channel where they can interfere with the flow of the slurry. Each fin defines two substantially opposite main surfaces and a thin lateral surface connecting the two.

The fins may protrude from one of the walls of the supply channel, for example they can be fixed on such a wall and extends from an internal surface of the wall in contact to the slurry. Preferably, the main surfaces of each fin are substantially perpendicular to the wall of the supply channel. The fins may have a height equal to the breath of the channel, so the fins may contact two opposite walls of the channel.

In case many fins are present, all fins can be joined by a connecting element, such as a bar or a frame. The bar or frame may also connect the fins in groups. Each group might have a single connecting element different from the other groups. The connection is useful in order to remove all fins at the same time for cleaning or repairing purposes. Further, it is useful so that the position of all fins can be regulated at the same time.

The fins may be attached directly to the walls of the channels. The fins may be connected by the bar or frame and the bar or frame may be attached to the walls and the fins themselves may not be in contact with the walls of the channel.

Each of the fins may define an axis or direction. The fins on a top view form substantially a curve. This curve has a first and a second end. The direction defined by the fins, thus their axis, is given by a line joining the first and the second end.

Preferably, a sub-group of the path diverting fins includes fins having parallel axis one to the other. Preferably, the fins form groups where all fins "point" toward the same direction. For example, the path diverting fins may be divided in rows, and each row includes fins having parallel axes among each other. The rows of fins are positioned one downstream the other along the direction of flow of the slurry, for example, if a first and a second row of fins are present, the first row of fins is located downstream the second row in the direction of flow of the slurry.

Preferably, the casting apparatus includes a first adjusting element apt to swivel the path diverting fins around an axis. As mentioned above, in a top view the fins define an axis. The orientation of this axis may be changed. Preferably, if there is a plurality of fins, the first adjusting element can change the orientation of the axes of all fins at the same time. Preferably, the orientation of the fins' axes is the same for all fins of the plurality.

Preferably, the casting apparatus includes a second adjusting element apt to slide along a direction the path diverting fins. As the axis of the fin can be changed, preferably also their position along an axis can be changed as well. A second adjusting element is thus foreseen which can shift he fins, for example translate them along a given axis, such as a vertical or horizontal axis. Preferably, in case of connected fins, the second adjusting element changes the position of all fins at the same time.

According to another aspect, the invention relates to a method to cast a sheet of a material containing alkaloids, the method comprising providing a casting box; providing a casting element connected to the casting box; providing a movable support facing the casting element; introducing the slurry in the casting box through an inlet and along a supply direction forming an angle with a horizontal plane comprised between about −45 degrees and about +45 degrees; and casting the slurry on the movable support by means of the casting element.

The advantages of the method have been already outlined when describing the apparatus and are not going to be repeated.

Preferably, introducing the slurry in the casting box comprises introducing the slurry up to a level above the inlet. The slurry is introduced in the casting box preferably till a given level is reached. Preferably, this given level is maintained within a selected range of level values. The slurry is removed continuously from the casting box to cast the sheet of material containing alkaloids, so in order to maintain the slurry level within the selected range, slurry needs to be added in the casting box. Preferably, this addition takes place below the slurry level, that is, the entrance of additional slurry is positioned at a height, which is lower than the height defined by the slurry level in the casting box. An introduction of slurry below the slurry level may allow a reduction of the number of air bubbles in the slurry.

Preferably, introducing the slurry in the casting box comprises providing a slurry supply element defining a supply channel connected to the inlet. The supply channel may include a pipe to transfer the slurry to the casting box. Preferably, this supply channel may be removable from the rest of the supply element.

Preferably, the method includes the step of feeding pressurised slurry to the supply channel.

Preferably, the pressure inside the casting box is maintained at a value comprised between about 1 bar and about 10 bar, more preferably between about 1 bar and about 5 bar, even more preferably between about 1 bar and about 3 bar.

Preferably, the feeding pressure of the slurry is maintained at a value comprised between about 1 bar and about 10 bar, more preferably between about 1 bar and about 5 bar, even more preferably between about 1 bar and about 3 bar.

Preferably, the method includes the step of providing the casting box with side walls and providing one of the side walls with an aperture defining the inlet.

Preferably, the cast sheet of a material containing alkaloids includes a homogenized tobacco sheet.

Preferably, the invention also relates to a casting apparatus to cast a sheet of a material, the casting apparatus including: a casting box apt to contain a slurry to be cast to form the sheet, the casting box defining an inner volume; a slurry supply element defining a supply channel apt to feed the slurry along a supply direction in the inner volume of the casting box from an inlet, the supply direction forming an angle with a horizontal plane comprised between about −45 degrees and about +45 degrees; a movable support; and a casting element apt to cast the slurry contained in the casting box onto the movable support so as to form the cast sheet.

Preferably, the invention also relates to a method to cast a sheet of a material, the method comprising: providing a casting box defining an inner volume; providing a casting element connected to the casting box; providing a movable support facing the casting element; introducing the slurry in the casting box through an inlet and along a supply direction forming an angle with a horizontal plane comprised between about −45 degrees and about +45 degrees; and casting the slurry on the movable support by means of the casting element.

Further advantages of the invention will become apparent from the detailed description thereof with no-limiting reference to the appended drawings wherein:

FIG. 1 shows a first embodiment of an apparatus 100 for the production of a web 50 of homogenized tobacco material according to the invention is shown.

Figure 1:
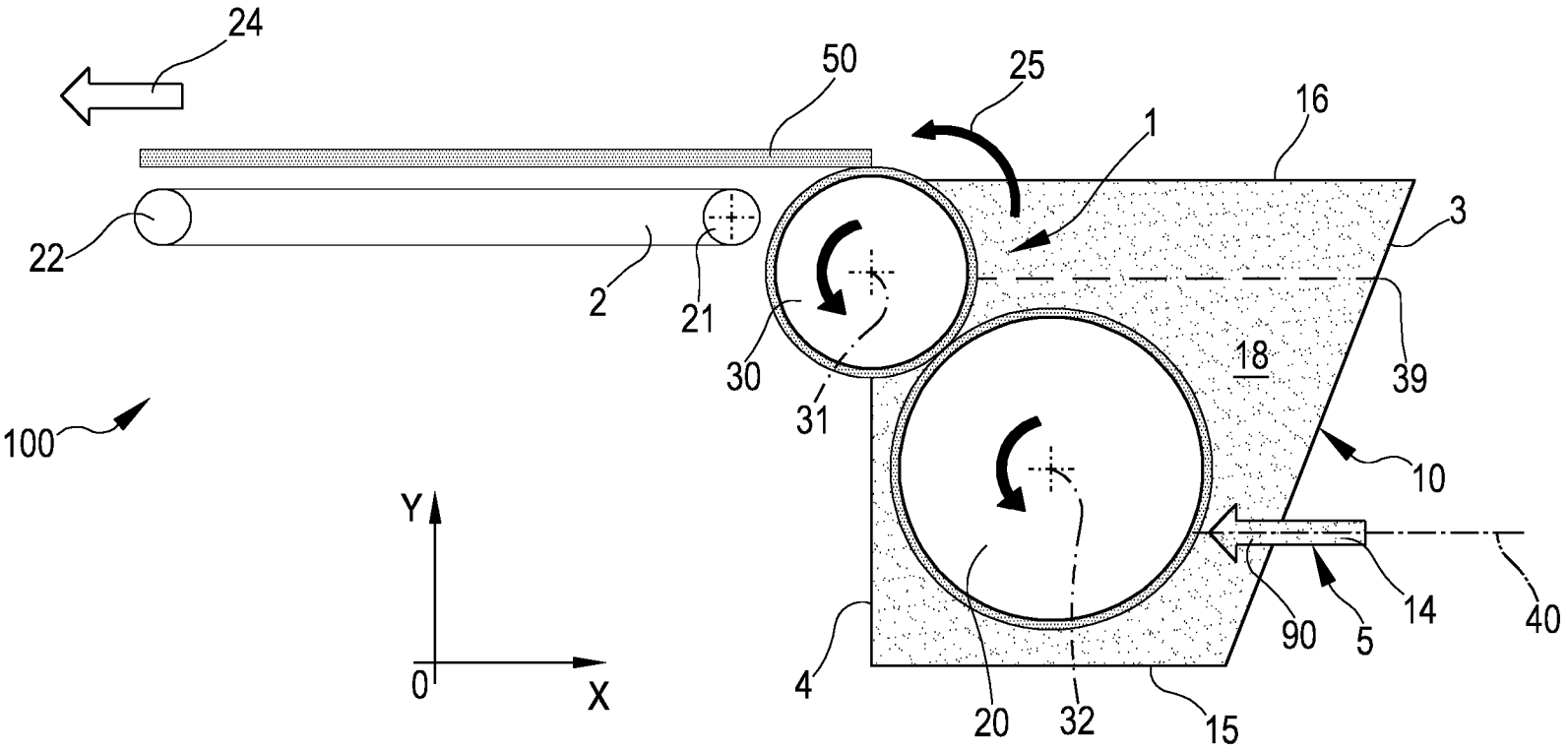
FIG. 1 is a schematic lateral section view of an apparatus for the production of a web of a material containing alkaloids.

The apparatus 100 comprises a casting box 10 containing slurry 18 and a movable support 2, wherein a casting element 1 casts the slurry 18 contained in the casting box 10 onto the movable support 2 so as to form the cast sheet 50 of homogenized tobacco material.

In this embodiment, the casting element 1 includes a casting roller 30 associated to the casting box 10.

The casting box 10 comprises side walls including a first and a second opposite walls 3, 4. The casting box 10 is generally defined by four side walls, i.e. the first and second opposite walls 3, 4 and a third and a fourth opposite walls (not shown in the figures), which connect the first and second opposite walls 3, 4.

Further, casting box 10 includes a bottom wall 15. It also includes an aperture 16, in this case coinciding with a top of the casting box and a portion of the wall 4. The aperture 16 is positioned in proximity of the movable support 2.

The movable support 2 comprises a continuous stainless steel belt including a drum assembly. Preferably, the steel belt is wound around a pair of opposite drums 21, 22. The slurry is casted on the steel belt—at the drum 21—through the casting roller 30.

The casted slurry, i.e. the cast sheet 50, is driven by the steel belt 2 along a casting direction indicated with an arrow 24 in FIG. 1 and enters a heating unit (not shown in the figures), where it is progressively heated and homogeneously dried.

The incoming slurry 18 is introduced into the casting box 1 from an inlet 90, connected to the side wall 4 of the casting box 10, which puts this incoming slurry 18 close to the bottom of the casting box 10.

Slurry 18 from buffer tanks (not shown in the drawings) is transferred into the casting box 10 usually by means of a pump (not shown in the drawings). Preferably, the pump comprises a control (not visible in the drawing) of flow rate to control the amount of slurry 18 introduced in the casting box 10. The pump is advantageously designed to ensure that slurry transfer times are kept to the minimum necessary.

The amount of slurry 18 in the casting box 1 has a pre-determined level, which is preferably kept substantially constant or within a given range. In order to keep the amount of slurry 18 substantially at the same level, the pump controls the flow of slurry 18 to the casting box 10. The predetermined level of slurry is indicated in FIG. 1 with a dashed line 39.

The casting roller 30 is associated to the casting box 10 in order to cast the slurry. The casting roller 30 has a dominant dimension which is its longitudinal width. The casting roller defines a first rotation axis 31 (indicated with a cross in FIG. 1) which is positioned along its longitudinal direction.

The casting roller 30 is attached in a rotatable manner to the casting box 10 preferably by means of its ends to two opposite side walls of the casting box. Further, the casting roller 30 protrudes partially from aperture 16 and faces movable support 2).

Between the casting roller 30 and the steel belt 2 a gap is present, the dimensions of which determine—among others—the thickness of the cast web 50 of homogenized tobacco material. Casting roller 30 and belt 2 face each other and the belt is partially positioned above the casting roller 30. The drum 21 transporting belt 2 preferably rotates in the same direction as the casting roller 30 (see direction of arrows 25 and 24).

The casting box 10 of the invention comprises also a second roller, transfer roller 20. Transfer roller 20 preferably has a diameter bigger than diameter of the casting roller 30. Preferably, transfer roller is cylindrical and defines as second rotation axis 32 (indicated with a cross in FIG. 1) parallel to first rotation axis 31. The transfer roller 20 is attached in a rotatable manner to the casting box 10 preferably by means of its ends to two opposite side walls. Further, the transfer roller 20 is located within casting box 1 in its entirety and it is submerged by slurry 18 at least in part. The rotation direction of transfer roller 2 is opposite to direction 25 or 24 of casting roller 30 and drum 2.

Between the casting roller 20 and the transfer roller 30 a gap is formed.

The apparatus 100 further includes a slurry supply element 5, which defines a supply channel 14 (represented as an arrow in FIG. 1). The supply channel 14 ends with the inlet 90, which is an opening on sidewall 4. The inlet 90 is as wide as the casting box, or slightly smaller. This inlet 90 is preferably oblong. The channel 14 is substantially horizontal, that is, it includes an axis which is horizontal, imparting to the slurry a supply direction along a substantially horizontal axis 40 while entering in the casting box 10 via inlet 90.

Figure 2:
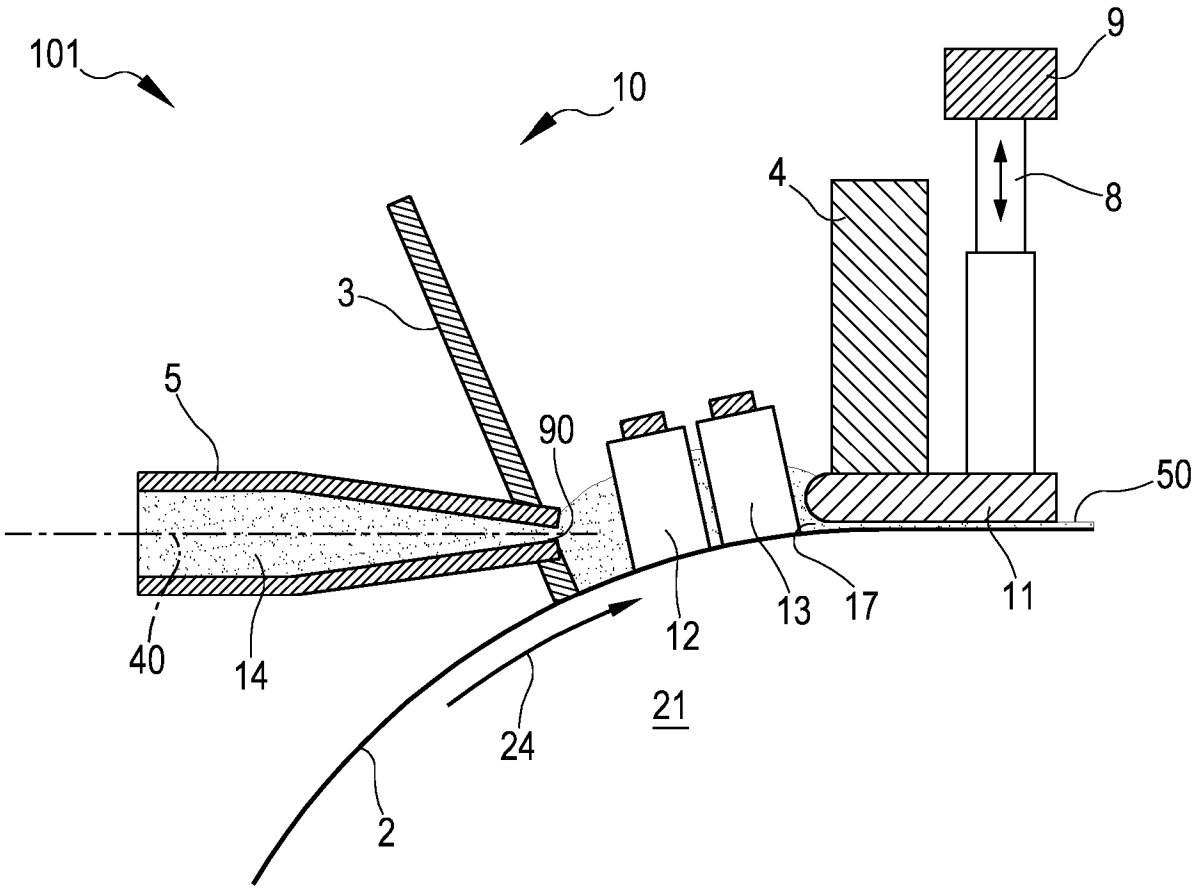
FIG. 2 is a schematic lateral section view of a second embodiment of an apparatus for the production of a web of a material containing alkaloids.

In FIG. 2, a second embodiment of casting apparatus 101 is shown. The casting apparatus 101 comprises a casting box 10 containing slurry, a movable support 2, and a casting blade 11 as casting element 1, wherein the casting blade 11 casts slurry 18 contained in the casting box 10 onto the movable support 2 so as to form the cast sheet 50 of homogenized tobacco material.

Slurry 18 is delivered to the casting box as described above, from a silo or tank.

The casting box 10 comprises sidewalls including a first and a second opposite walls 3, 4. The casting blade 11 is associated to the casting box 10 at the second wall 4. The casting box 10 is generally defined by four side walls, i.e. the first and second opposite walls 3, 4 and a third and a fourth opposite walls (not shown in the figures), which connect the first and second opposite walls 3, 4.

The movable support 2 comprises for example a continuous stainless steel belt including a drum assembly. The drum assembly includes a main drum 21 located below the casting box 10 which moves the movable support 2. Preferably, the casting box 10 is mounted on top of the main drum 21.

The slurry is casted on the steel belt—at the drum 21—through the casting blade 11, which creates a continuous sheet of homogenized tobacco material. In order for the slurry to reach the casting blade and thus the movable support, the casting box 10 has an opening or aperture 17 in correspondence of its bottom and the opening 17 extends along a width of the casting box 10. The opening 17 is positioned over and in proximity of the drum 21.

The top portion of the casting box 10 in this embodiment is open.

The movement of the steel belt 2 forwards the slurry 18 towards the casting blade 11, for example towards the second wall 4. The casting blade 11 casts a part of the slurry 18 on the steel belt 2, while the remaining majority of the slurry 18 turns back and recirculates inside the casting box 10. The steel belt 2 moves along a casting direction (see the arrow 24 in the figures).

The casting blade 11 is associated to the casting box 10 in order to cast the slurry. The casting blade 11 has a dominant dimension which is its longitudinal width. The casting blade is for example substantially rectangular. The casting blade is positioned preferably orthogonal to the casting direction, that is, its longitudinal width is preferably perpendicular to the casting direction.

The casting blade 11 is attached to the casting box 10 preferably by means of an adjustable board 8 operated by an actuator 9 which allows a precise control of the position of the casting blade 11, in particular of its distance with respect to the movable support 2.

Between the casting blade 11 and the movable support 2 a gap is present, the dimensions of which determine—among others—the thickness of the cast web of homogenized tobacco material.

The apparatus 101 further includes a slurry supply element 5, which defines a supply channel 14. The supply channel 14 ends with the inlet 90, which is an opening on sidewall 3. The inlet 90 is as wide as the casting box, or slightly smaller. This inlet 90 is preferably oblong. The channel 14 is substantially horizontal, imparting to the slurry feed or supply direction along a substantially horizontal axis 40.

Further, casting box 10 includes a plurality of fins. The fins are arranged in two substantially parallel first and second row. Any number of rows is possible. The fins of the first row are indicated with 12 and the fins of the second row are indicated with 13. All fins of the first row and all fins of the second row are connected together by respective longitudinal bars (not visible). The number of fins in each row is such that the whole width of the casting box, which is substantially preferably equal to the width of the casting blade 1, is spanned.

Figure 3:
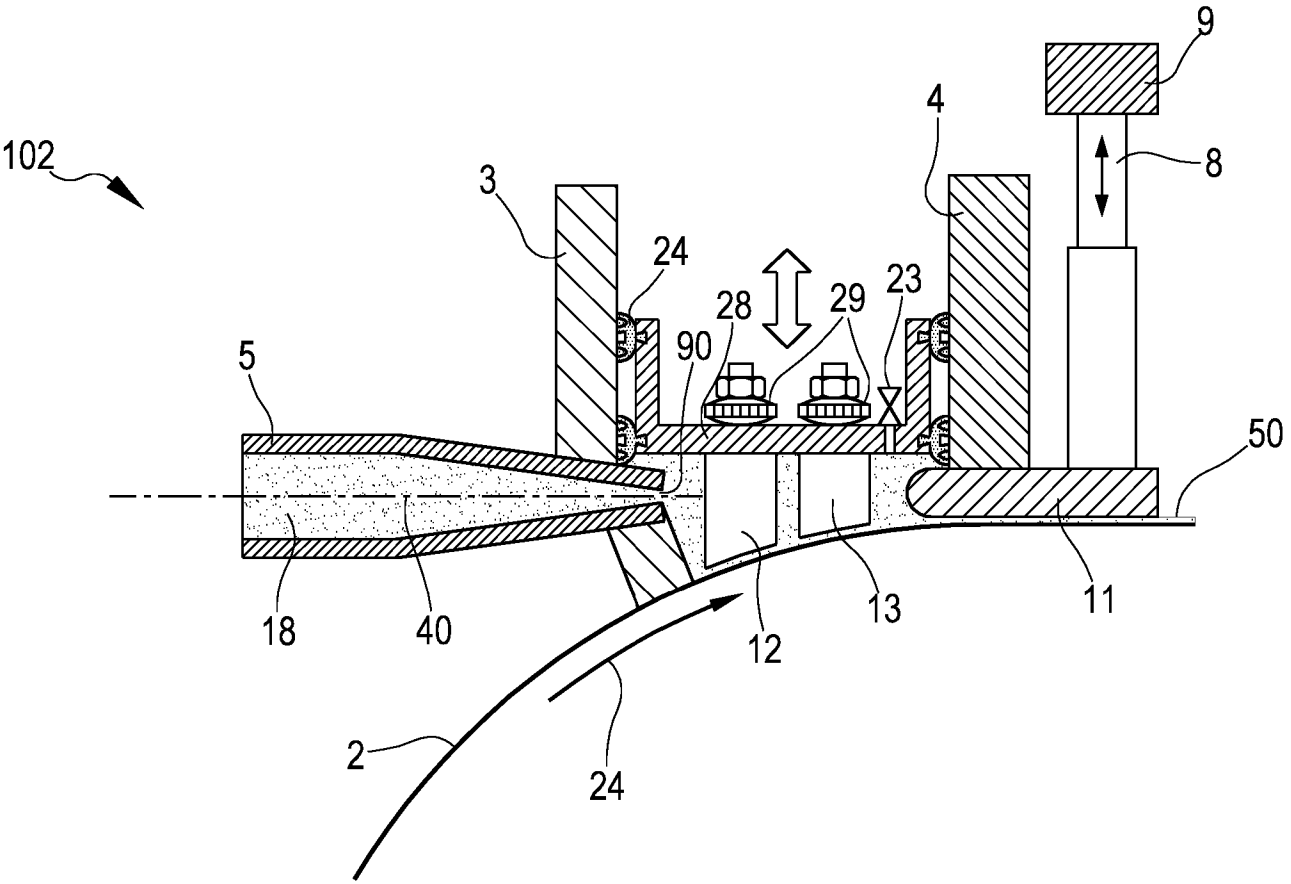
FIG. 3 is a schematic lateral section view of a third embodiment of an apparatus for the production of a web of a material containing alkaloids.

With now reference to FIG. 3, a third embodiment of the apparatus 102 is disclosed. Apparatus 102 in this embodiment is similar to that of embodiment of apparatus 101 but it also includes a lid 28. The lid 28 may be fixed or it may slide on the sidewalls 3,4. Lid 28 defines opposite surfaces called internal and external. The internal surface faces the slurry, while the external is opposite to it. The lid 28 may be in contact with the slurry. The walls and lid of the casting box 10 defines a pressurized container. In order to be able to vary the pressure value inside such a pressurized container, a valve (or more than a valve) 23 is positioned on the external surface of the lid 28. The maximum value of acceptable pressure can be changed on the valve 23.

Further, the first and the second row 12, 13 of fins extend from the internal surface of the lid towards the slurry 2. The two rows of fins are preferably attached to the lid. On the opposite side of the lid, i.e. on the external surface, regulation devices, both indicated by 29, are accessible by a user and can be used to rotate the fins 12, 13. Regulation devices 29 may include knobs.

Slurry 18 is introduced in the casting box by means of the slurry supply element 5 configured as in the embodiment of FIG. 2.

Figure 4:
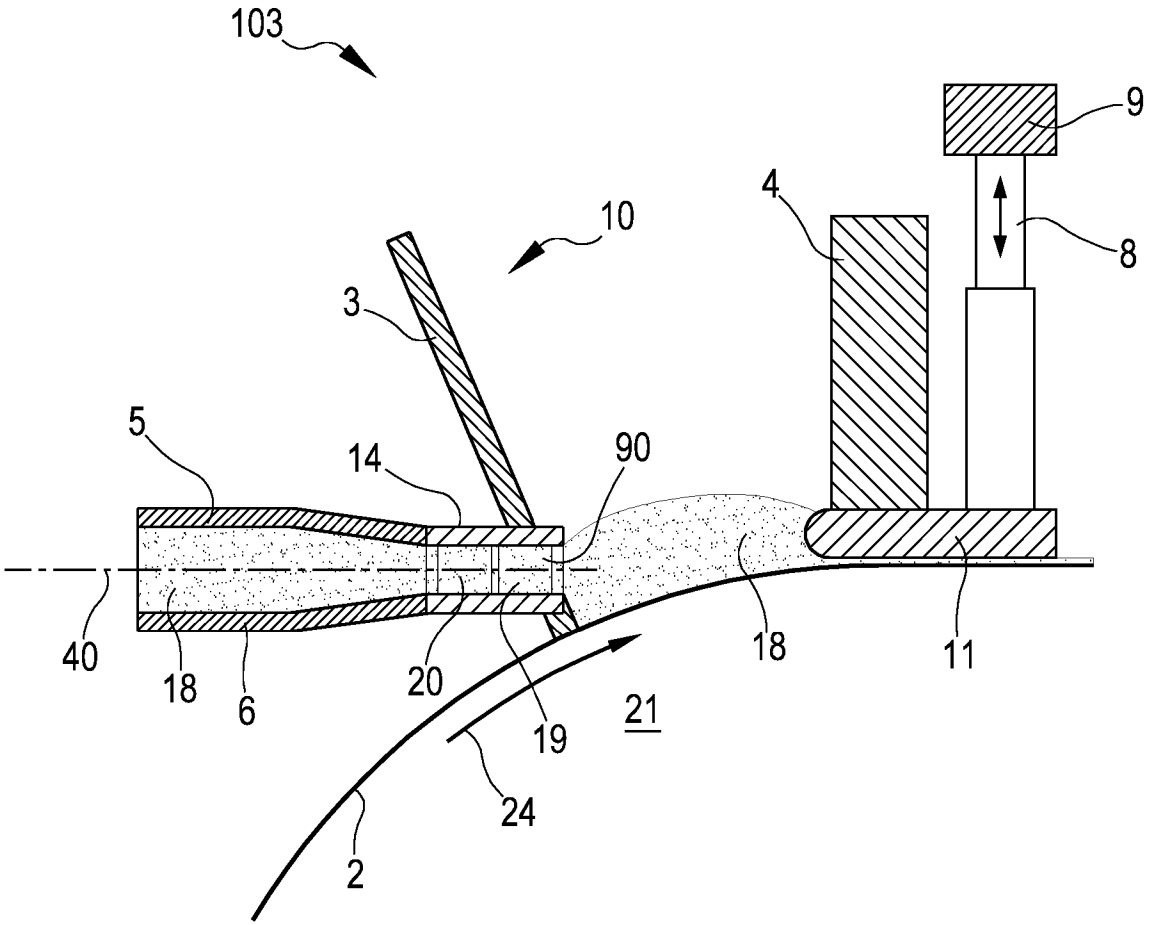
FIG. 4 is a schematic lateral section view of a fourth embodiment of an apparatus for the production of a web of a material containing alkaloids.

In FIG. 4, a fourth embodiment of a casting apparatus 103 is disclosed. Casting apparatus 103 is similar to casting apparatus 102 except for the position of the fins.

In this embodiment, the fluid supply element 5 includes a channel 14 which defines an inlet 90. The inlet 90 is substantially an aperture formed on the sidewall 3 of the casting box 10. Preferably, channel 14 is arranged substantially horizontal, that is, it defines a horizontal axis, so that at the aperture formed by the channel on the sidewall, i.e. at the inlet 90, the direction of the flow 40 of slurry is substantially horizontal.

Further, casting box 10 includes a plurality of fins located in the channel 14. The fins are arranged in two substantially parallel first and second row. Any number of rows is possible. The fins of the first row are indicated with 19 and the fins of the second row are indicated with 20. The height of the fins is substantially similar to the smaller dimension of the cross section of channel 5.

A first and a second adjusting elements, not visible in the drawings, may operate on the fins in order to change their position. First adjusting element may rotate the fins around an axis so that their orientation changes, while second adjusting element may change the exact position along the channel 14, closer or more remotely from inlet 90.

Slurry supply element 5, upstream the fins 19, 20 in the direction of flow of the slurry 18 in the channel 14, also includes a tapered portion 6. The fins are located downstream the tapered portion, in the direction of flow of the slurry.

The functioning of the casting apparatus 100-103 is as follows. A slurry 18, formed preferably mixing and combining tobacco powder and other ingredients, is transferred from a buffer tank (not shown) using for example in line mixers (also not shown) to the casting apparatus 100-103 and in particular inside the casting box 10.

The slurry 18 is supplied for example by an horizontal channel 14 having the inlet 90, which is positioned at a rear or upstream side of casting box 10 (at the sidewall 3 of the casting box 10) and the casting element 1 is located at a front or downstream side of the casting box 10, near the sidewall 4.

Further, the level 39 of slurry in the casting box 10 is monitored, as well as the moisture of the slurry inside the casting box 10, and the density of the slurry 18, by means of suitable sensors.

The slurry 18 is cast on the movable support 2 by the casting element 1 forming cast sheet 50. The casting is performed by means of casting element 1 forming a gap with the movable support 2, gap that can also be feedback controlled.

The thickness of the sheet 50 of homogenized tobacco material and grammage controlled by nucleonic gauge immediately after casting are continuously monitored and feedback-controlled using slurry measuring device. In case fins are present, a mixing of the slurry in the channel 14 or in the casting box 10 takes place as well.

Further, the cast sheet 50 undergoes a drying step by means of a drying apparatus (not visible in the drawings). The drying apparatus includes a plurality of individual drying zones. Each drying zone preferably includes steam heating on the bottom side of the support and heated air above the movable support 2 and preferably also adjustable exhaust air control. Within the drying apparatus, the homogenized tobacco sheet is dried to desired final moisture on the support 2.

The drying step includes preferably a uniform and gentle drying of the cast sheet in an endless, stainless steel belt dryer with individually controllable zones. During the drying, a monitoring step of the cast web temperature at each drying zone to ensure a gentle drying profile at each drying zone is preferably performed. The cast sheet is dried to desired final moisture on the steel belt 2 with steam pan heating from bottom and top air drying. Every drying zone is equipped with steam flow and pressure control and air temperature and air flow are fully adjustable to provide the desired drying profile and ensuring product residence time is respected.

The invention claimed is:

1. A casting apparatus to cast a sheet of a material containing alkaloids, the casting apparatus including:

a casting box adapted to contain a slurry to be cast to form the sheet;

a slurry supply element defining a supply channel adapted to feed the slurry along a supply direction inside the casting box from an inlet, the supply direction forming an angle with a horizontal plane comprised between about −45 degrees and about +45 degrees;

a movable support;

a casting element adapted to cast the slurry contained in the casting box onto the movable support so as to form the cast sheet; and path diverting fins positioned within the supply channel, the path diverting fins being adapted to come into contact with the slurry inside the supply channel.

2. The casting apparatus according to claim 1, wherein the slurry supply element includes a tapered end portion connected to the inlet.

3. The casting apparatus according to claim 1, wherein the casting box comprises lateral walls including an aperture defining the inlet.

4. The casting apparatus according to claim 3, wherein the aperture extends for at least 50% of a width of one lateral wall.

5. The casting apparatus according claim 3, wherein the aperture extends along a main direction parallel to a horizontal plane.

6. The casting apparatus according to claim 5, wherein the main direction is perpendicular to the supply direction.

7. The casting apparatus according to claim 3, wherein the aperture is formed in a lateral wall opposite to the casting element.

8. The casting apparatus according to claim 1, wherein the supply direction forms an angle with a horizontal plane comprised between about −15 degrees and about +15 degrees.

9. The casting apparatus according to claim 1, wherein the path diverting fins protrude from one of walls of the supply channel.

10. The casting apparatus according to claim 1, wherein main surfaces of each path diverting fin are substantially perpendicular to a wall of the supply channel.

11. The casting apparatus according to claim 1, wherein the path diverting fins have a height equal to a breath of the supply channel, so to contact two opposite walls of the supply channel.

12. The casting apparatus according to claim 1, including a first adjusting element adapted to swivel the path diverting fins around an axis.

13. The casting apparatus according to claim 12, including a second adjusting element adapted to slide along a direction the path diverting fins.

14. The casting apparatus according to claim 2, wherein the path diverting fins are located downstream the tapered portion, in a direction of flow of the slurry.

15. A casting apparatus to cast a sheet of a material containing alkaloids, the casting apparatus including:

a casting box adapted to contain a slurry to be cast to form the sheet;

a slurry supply element defining a supply channel adapted to feed the slurry along a supply direction inside the casting box from an inlet, the supply direction forming an angle with a horizontal plane comprised between about −45 degrees and about +45 degrees;

a movable support; and a casting element adapted to cast the slurry contained in the casting box onto the movable support so as to form the cast sheet;

path diverting fins adapted to come into contact with the slurry and placed within the casting box, each path diverting fin defining two opposite main surfaces and a thin lateral surface connecting the two opposite main surfaces; wherein the path diverting fins are mounted so that they face with their thin lateral surface the movable support or a bottom aperture of the casting box.

16. The casting apparatus according to claim 15, wherein the path diverting fins are curved.

17. The casting apparatus according to claim 15, wherein the path diverting fins are connected all together by suitable bars or a frame fixed at sidewalls of the casting box.

18. The casting apparatus according to claim 15, wherein the path diverting fins are fixed to a lid of the casting box.

19. The casting apparatus according to claim 15, including a first adjusting element adapted to swivel the path diverting fins around an axis.

20. The casting apparatus according to claim 19, including a second adjusting element adapted to slide along a direction the path diverting fins.

* * * * *